United States Patent [19]

Yaremchuk

[11] 3,974,918

[45] Aug. 17, 1976

[54] MAGNETIC BOOK SUPPORTING STRUCTURE

[76] Inventor: George Yaremchuk, 5138 Lonyo, Detroit, Mich. 48210

[22] Filed: Jan. 17, 1975

[21] Appl. No.: 541,739

[52] U.S. Cl. ..... 211/43; 211/DIG. 1; 211/184

[51] Int. Cl.[2] ..... A47B 65/00

[58] Field of Search ..... 108/61; 211/42, 43, 211/184, DIG. 1; 220/22.1, 22.2; 248/206 A

[56] References Cited

UNITED STATES PATENTS

| | | | |
|---|---|---|---|
| 1,621,410 | 3/1927 | House | 211/43 |
| 1,891,420 | 12/1932 | Jaquith | 211/43 |
| 2,096,634 | 10/1937 | Gilbert | 211/43 |
| 3,228,133 | 1/1966 | Baermann | 248/206 A X |
| 3,604,564 | 9/1971 | Weyll | 211/43 |

*Primary Examiner*—Lawrence J. Staab
*Attorney, Agent, or Firm*—Whittemore, Hulbert & Belknap

[57] ABSTRACT

An elongated strip of magnetic material in combination with bookends, having magnetic members secured to the bottoms thereof whereby the magnetic bookends may be more efficiently utilized on wooden desks or the like in conjunction with the metallic strip.

2 Claims, 7 Drawing Figures

MAGNETIC BOOK SUPPORTING STRUCTURE

BACKGROUND OF THE INVENTION

1. Field of the Invention

The invention relates to book supporting structure and refers more specifically to an elongated strip of magnetic material in combination with bookends with magnetic members on the bottom thereof, which elongated strip of magnetic material permits more efficient use of the bookends on wooden desks or the like.

2. Description of the Prior Art

Bookends for maintaining books upright on shelves have, of course, been known for many years. Bookends having magnets in conjunction therewith for use on metal shelving have also been known. The use of magnetic bookends has in the past, however, been limited primarily to institutions such as public libraries and the like having metal book stacks. The magnetic bookends have not been available for use in conjunction with individual non-magentic desks, credenzas, or the like. In such smaller installations, the maintaining of the bookends in a predetermined, spaced apart relation has generally been solely by the weight of the bookends, or perhaps by bookend portions adapted to slip under the lower end of books between the bookends. Such bookends have caused scarring of desks and the like and wear of the lower edges of books positioned therebetween, as well as not being totally efficient in preventing movement of the bookends by the weight of the books supported thereby.

SUMMARY OF THE INVENTION

In accordance with the invention, there is provided an elongated strip of magnetic material and a pair of bookends having magnets secured to the bottom thereof.

The strip of elongated magnetic material may be placed on a desk of non-magnetic material or any other non-magnetic support therefor and the bookends placed on the magnetic strip at spaced apart locations to support books positioned therebetween. The bookends so positioned are held in predetermined spaced apart relation by the magnetic attraction between the magnets on the bookends and the magnetic material of which the elongated strip is constructed.

The magnets and/or the strip of magnetic material may be polymeric or elastomeric to prevent scarring of surfaces on which they are positioned. Alternatively, the strip of magnetic material may be metal and have a felt covering on one side thereof to prevent scarring of supporting structures therefor.

DESCRIPTION OF THE PREFERRED EMBODIMENT

Figure 1:
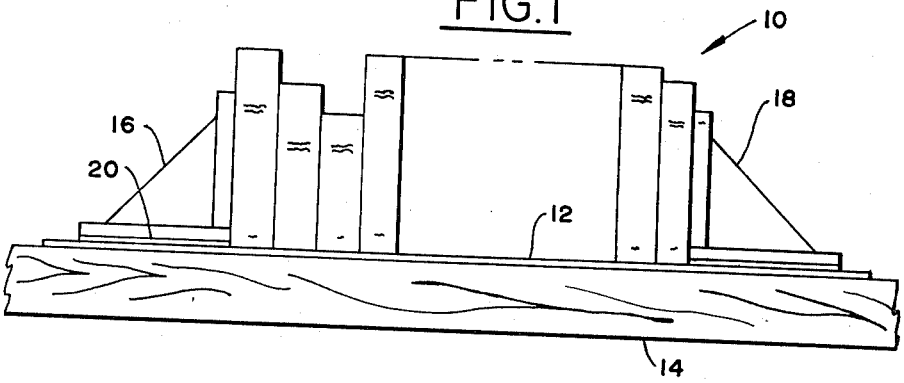
FIG. 1 is an elevation view of book supporting structure constructed in accordance with the invention.
Figure 2:
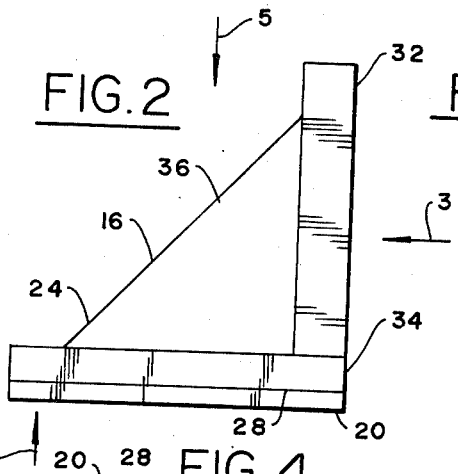
FIG. 2 is an enlarged elevation view of one of the bookends of the book supporting structure illustrated in FIG. 1.

As shown best in FIG. 1, the book supporting structure 10 includes an elongated strip of magnetic material 12 which is placed on a wooden desk top 14 or the like, and a pair of bookends 16 and 18 positioned in spaced apart locations along the strip of magnetic material 12. As shown, the bookends 16 and 18 include magnets 20 and 22 on the bottom thereof for maintaining the bookends 16 and 18 in predetermined spaced apart locations on the strip of elongated magnetic material 12.

The bookends 16 and 18 are identical, so that only bookend 16, as shown in FIGS. 2-5, will be described in detail herein. The bookend 16 includes a horizontal member 24 having recesses 28 and 30 along opposite bottom edges thereof, as shown. A vertically extending member 32 is secured to the end 34 of the horizontal member 24 by convenient means, not shown. A bracing member 36 is positioned between the horizontal member 24 and the vertical member 32 and is secured thereto by convenient means, not shown. All of the members 24, 32 and 36 may be constructed of any desirable material such as plastic, wood or metal.

Figure 3:
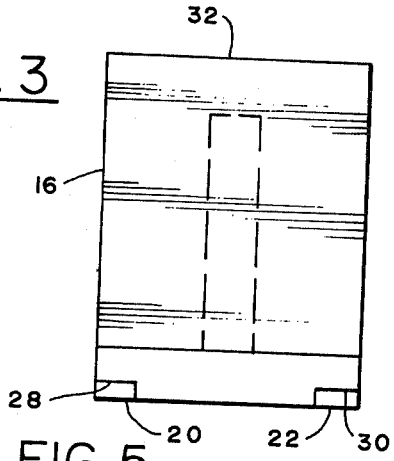
FIG. 3 is an elevation view of the bookend illustrated in FIG. 2, taken in the direction of arrow 3 in FIG. 2.
Figure 4:
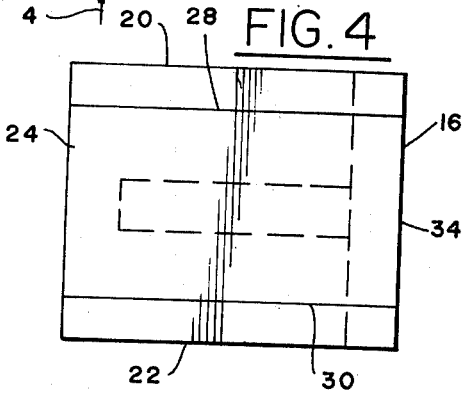
FIG. 4 is a bottom view of the bookend illustrated in FIG. 2, taken in the direction of arrow 4 in FIG. 2.
Figure 5:
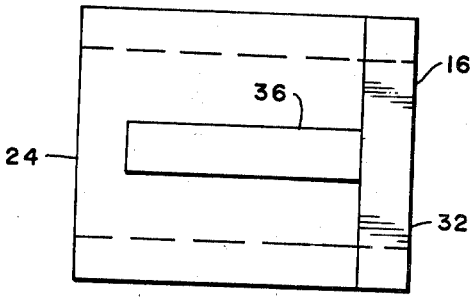
FIG. 5 is a top view of the bookend illustrated in FIG. 2, taken in the direction of arrow 5 in FIG. 2.

Magnets 20 and 22 are secured in the recesses 28 and 30, as shown best in FIG. 3. The magnets 20 and 22 may be the usual elongated bar magnets or, if desired, may be circular and need not be placed at the edges of the horizontal member 24, but should be placed adjacent the bottom of the horizontal member 24, since they must react with the magnetic material of the elongated strip 12 with the bookends 16 and 18 in position of the strip 12.

Preferably the magnets 20 and 22 are strips of polymeric or elastomeric material having magnetized metallic particles imbedded therein. Since such material may be flexible, it will not scratch surfaces it comes in contact with, and may be secured to most materials by adhesive.

The elongated magnetic strip 12, as shown in FIG. 1, may also be constructed of polymeric or elastomeric material having metal particles imbedded therein so as to be completely flexible and is therefore portable and easily capable of being packaged along with the bookends 16 and 18. Again, such material will not scratch the surface on which it is positioned such as the surface of a wooden desk or the like, and has a good coefficient of friction and therefore is not liable to be moved in its entirety along with the bookends by slipping on the material of a surface 14 such as wood.

Figure 7:
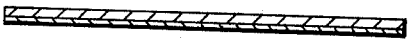
FIG. 7 is a cross section of the strip of magnetic material illustrated in FIG. 6, taken in the direction of arrows 7—7 in FIG. 6.
Figure 6:
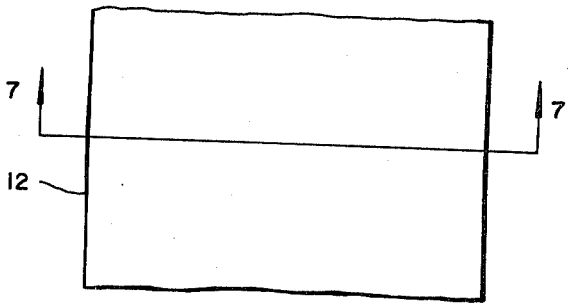
FIG. 6 is a partial enlarged plan view of the strip of magnetic material of the book supporting structure illustrated in FIG. 1.

Alternatively, the elongated magnetic strip 12, as shown in FIGS. 6 and 7, may be constructed of metal. In such cases where the strip is a metal strip, a covering of felt 38 or the like is placed on one side thereof to prevent damage to the surface on which the elongated magnetic strip is positioned.

In use, the elongated strip of magnetic material and the bookends are packaged so as to be portable and can thus be taken to any desired location, unpackaged, and the strip set on a non-magnetic surface such as the wooden surface 14. The bookends 16 and 18 are then positioned on the strip of magnetic material 12 in spaced apart location. The space between the bookends 16 and 18 will depend on the number and the width of books to be supported between the bookends in the usual manner. The magnets 20 and 22 will then react with the elongated strip of magnetic material 12 to prevent movement of the bookends 16 and 18 along the strip of magnetic material 12 due to forces applied thereto through the books supported thereby in a horizontal direction.

while one embodiment of the present invention has been considered in detail and modifications thereof suggested, it will be understood that other modifications and embodiments of the invention are contemplated. It is the intention to include all such embodiments and modifications as are defined by the appended claims within the scope of the invention.

What I claim as my invention is:

1. In combination, a flat elongated, elastomeric strip having magnetic metal particles therein, and a pair of bookends of a size to be easily portable with the elongated strip having magnets secured thereto whereby the bookends are cooperable with the elongated strip in its flat condition when placed in spaced apart locations along the strip to support bookds on the strip between the bookends against the pressure of the books in the direction of the elongation of the strip said strip being completely flexible and therefore portable and easily capable of being packaged along with the bookends.

2. In combination, a flat, elongated elastomeric strip having magnetic metal particles therein, a pair of bookends of a size to be readily portable with the strip each comprising a horizontally extending member substantially the same width as the elongated strip, a vertically extending member connected to the horizontally extending member at one end thereof, and a bracing member positioned between the horizontally and vertically extending members and secured thereto and magnetic strips secured to the horizontally extending member along the lower edges thereof, said bookends adapted to be positioned in spaced apart locations on the flat elongated strip to secure books in place therebetween on the flat elongated strip against the pressure of the books in the direction of elongation of the elongated strip the elongated strip being completely flexible and therefore portable and easily capable of being packaged along with the bookends whereby the elongated strip and bookends may be carried from place to place and assembled with the strip in a flat condition and the bookends in spaced apart positions thereon to retain books on desks or the like having non-metallic surfaces.

* * * * *